US010679802B2

(12) United States Patent
I

(10) Patent No.: US 10,679,802 B2
(45) Date of Patent: Jun. 9, 2020

(54) PUSH SWITCH

(71) Applicant: GREEN IDEA TECH INC., Mahe (SC)

(72) Inventor: Hsiang-Yun I, Tainan (TW)

(73) Assignee: GREEN IDEA TECH INC., Mahe (SC)

( * ) Notice: Subject to any disclaimer, the term of this patent is extended or adjusted under 35 U.S.C. 154(b) by 0 days.

(21) Appl. No.: 16/212,558

(22) Filed: Dec. 6, 2018

(65) Prior Publication Data

US 2020/0013565 A1 Jan. 9, 2020

(30) Foreign Application Priority Data

Jul. 3, 2018 (TW) ..... 107123016 A

(51) Int. Cl.
*H01H 13/20* (2006.01)
*H01H 85/08* (2006.01)
*H01H 13/56* (2006.01)

(52) U.S. Cl.
CPC ..... *H01H 13/20* (2013.01); *H01H 85/08* (2013.01); *H01H 13/56* (2013.01)

(58) Field of Classification Search
CPC ..... H01H 13/20; H01H 85/08; H01H 13/56; H01H 3/54; H01H 3/12; H01H 3/022; H01H 2221/068; H01H 2239/06; H01H 2221/016; H01H 2221/044; H01H 1/24; H01R 13/7137; H01R 25/003
USPC ..... 337/298, 333, 334, 342, 343, 379, 380, 337/388, 401, 407
See application file for complete search history.

(56) References Cited

U.S. PATENT DOCUMENTS 3,846,729 A * 11/1974 Sorimachi ..... H01H 73/30 337/343
4,013,857 A * 3/1977 Tanaka ..... H01H 23/025 200/315
4,115,673 A * 9/1978 Smith ..... H01H 23/025 200/315
4,220,836 A * 9/1980 Hersey ..... H01H 35/343 200/83 P
4,295,114 A * 10/1981 Pohl ..... H01H 37/764 337/3

(Continued)

*Primary Examiner* — Anatoly Vortman
*Assistant Examiner* — Stephen S Sul
(74) *Attorney, Agent, or Firm* — Michael D. Eisenberg

(57) ABSTRACT

A push switch, having a conductive member which includes three integrally formed components: a conductive element, a U-shaped clip, and a conductive cantilever element. An overheating destructive element is provided on the conductive cantilever element, and the overheating destructive element can be destroyed at a destructive temperature, in which the destructive temperature is between 100° C. to 250° C. The push switch has a contact element in contact with the overheating destructive element so as to control the conductive cantilever element to be electrically connected or disconnected. When the conductive cantilever element is electrically connected, and if the overheating destructive element is overheated and destroyed, the conductive cantilever element is driven to become electrically disconnected, thereby achieving protection against overheating. The integral formation and manufacturing of the conductive member has the advantages of being structurally simple and easy to assemble.

3 Claims, 10 Drawing Sheets

(56) References Cited

U.S. PATENT DOCUMENTS 5,847,638 A * 12/1998 Sorenson ..... H01H 77/04 337/380
5,861,794 A * 1/1999 Pellon ..... H01H 77/04 337/348
5,982,269 A * 11/1999 Sorenson ..... H01H 73/26 200/553
6,252,490 B1 * 6/2001 Lin ..... H01H 23/025 337/37
6,275,133 B1 * 8/2001 Chen ..... H01H 73/26 337/112
6,275,134 B1 * 8/2001 Chen ..... H01H 73/26 337/37
6,307,459 B1 * 10/2001 Yu ..... H01H 73/14 337/112
6,323,450 B1 * 11/2001 Chen ..... H01H 71/54 200/553
6,377,159 B1 * 4/2002 Yu ..... H01H 73/303 337/112
6,445,275 B2 * 9/2002 Yu ..... H01H 73/30 200/283
6,469,610 B1 * 10/2002 Chen ..... H01H 73/26 200/553
6,525,639 B1 * 2/2003 Cheng ..... H01H 73/26 200/553
6,570,480 B1 * 5/2003 Huang ..... H01H 23/025 116/279
6,674,034 B1 * 1/2004 Wang ..... H01H 13/60 200/334
6,734,779 B2 * 5/2004 Yu ..... H01H 73/26 337/56
6,747,225 B1 * 6/2004 Yu ..... H01H 73/30 200/334
6,897,392 B2 * 5/2005 Huang ..... H01H 23/205 200/315
7,049,538 B2 * 5/2006 Camillo ..... H01H 23/162 200/339
7,116,207 B1 * 10/2006 Yu ..... H01H 73/26 337/59
7,202,769 B2 * 4/2007 Yu ..... H01H 73/26 337/37
7,283,031 B2 * 10/2007 Huang ..... H01H 73/26 337/56
7,292,129 B2 * 11/2007 Yu ..... H01H 73/26 337/112
7,307,506 B2 * 12/2007 Yu ..... H01H 73/26 337/56
7,355,139 B1 * 4/2008 Yu ..... H01H 5/18 200/400
7,626,482 B2 * 12/2009 Huang ..... H01H 23/24 337/59
8,154,375 B2 * 4/2012 Chen ..... H01H 73/30 200/341
9,218,926 B1 * 12/2015 Pierce ..... H01H 1/26
2001/0006145 A1 * 7/2001 Yu ..... H01H 73/30 200/524
2004/0037020 A1 * 2/2004 Yu ..... H01H 73/26 361/103
2005/0264392 A1 * 12/2005 Yu ..... H01H 73/26 337/66

* cited by examiner

PUSH SWITCH

CROSS REFERENCES TO RELATED APPLICATIONS

The present application claims priority from Taiwanese Patent Application Serial Number 107123016, filed Jul. 3, 2018, the disclosure of which is hereby incorporated by reference herein in its entirety.

BACKGROUND OF THE INVENTION

(a) Field of the Invention

The present invention relates to a push switch and, more particularly, to such a push switch having applied thereto a conductive member comprising a conductive element, a U-shaped clip, and a conductive cantilever element which are integrally formed, so as to achieve effects of simplification in structure and ease in assembly.

(b) Description of the Prior Art

In a conventional push switch, a push operation can be used to repeatedly control connection and disconnection of the switch each time, and a button thereof employs a reciprocal button structure similar to a conventional automatic ball-point pen, such that the button of the switch is fixed in a lower position or an upper position each time when the button is pushed; for instance, the push switch disclosed in China Patent No. CN103441019 entitled "Button Switch".

In R.O.C. Patent No. 321352 which is entitled "Improved Structure of the On-wire Switch", a switch structure having a fuse is disclosed, and yet the fuse is located in a path of a live wire of a power source, which means a current is required to flow through for the protection effect to be available, given that only an overloaded current could possibly melt the fuse, and since a fuse is required to allow currents to flow through during operation but also must be capable of being melted when there are excessive currents, a lead-tin alloy or zinc having low melting points are often used as fuses, of which the conductive performances are much poorer than that of copper. Using an extension cord as an example, in which copper is mainly used as a conducting body, if the extension cord has combined therein the switch of the R.O.C. Patent No. 321352 for controlling a power source, the conductivity of the fuse would be poor, which leads to the issue of excessive energy consumption.

SUMMARY OF THE INVENTION

The overheating destructive element of the present invention is not used to conduct currents, and the overheating destructive element has the effect of destruction by overheating even though the conductivity thereof is poor or is even non-conducting. Based on the above-mentioned reasons, the present invention discloses a conductive member structure of a push switch, comprising:

a conductive element; a U-shaped clip having a fixing portion and a working portion, wherein the fixing portion and the conductive element are integrally formed; a conductive cantilever element integrally formed with the working portion, wherein the conductive cantilever element has a mounting recess; an overheating destructive element accommodated in the mounting recess, wherein the overheating destructive element can be destroyed at a destructive temperature and the destructive temperature is between 100° C. to 250° C.

In addition, the mounting recess is a mounting hole and the overheating destructive element is accommodated in the mounting hole, such that the overheating destructive element is embeddingly engaged on the periphery of the mounting hole. Further, the overheating destructive element has a through hole in correspondence with the mounting hole, and the overheating destructive element has a rib on the periphery thereof; the overheating destructive element is penetrated and extended into the mounting hole and is tightly cooperated with an inner edge of the mounting hole, such that the rib is pressed against the periphery of the mounting hole.

In addition, the mounting recess is a mounting groove and the mounting groove has a bottom surface; the overheating destructive element is accommodated in the mounting groove and supported by the bottom surface.

In addition, the mounting recess is a mounting groove and the mounting groove has a bottom surface; a thermal conductive shell is accommodated in the mounting groove and supported by the bottom surface, and the overheating destructive element is accommodated in the thermal conductive shell.

In addition, the conductive cantilever element has a silver contact point thereon.

The present invention further discloses a push switch, comprising: a base having a receiving space, wherein the base is provided with a protruding portion; an operating component sleeved on the protruding portion, wherein the operating component comprises an operating element and a first elastic element, the operating element reciprocally moves on the protruding portion in a limited manner and comprises a contact element and a limiting element, the first elastic element is compressively limited between the contact element and the limiting element and has a first elastic force; a first conductive element penetrated into and provided in the base; a second elastic element which is a U-shaped clip, wherein the U-shaped clip has a fixing portion and a working portion, the fixing portion is integrally formed with the first conductive element, and the U-shaped clip has a second elastic force which indirectly acts on the operating element; a conductive cantilever element provided in the receiving space and integrally formed with the working portion, wherein the conductive cantilever element has a mounting hole thereon; a second conductive element penetrated into and provided in the base, wherein the conductive cantilever element is selectively connected to the second conductive element; an overheating destructive element accommodated in the mounting hole and pressed against the contact element, wherein the overheating destructive element can be destroyed at a destructive temperature and the destructive temperature is between 100° C. to 250° C.

When the operating element is in a first position, the first elastic force forces the conductive cantilever element to be contacted with the second conductive element so as to form an electrically connected state; in the electrically connected state, currents flow through the first conductive element, the conductive cantilever element and the second conductive element to generate a heat energy, and the overheating destructive element absorbs the heat energy and be destroyed at the above-described destructive temperature, such that the first elastic force is reduced or lost, thus making the second elastic force to be greater than the first elastic force, and the second elastic force forces the operating element to move to a second position, such that the conductive cantilever element becomes separated from the second conductive element to form an electrically disconnected state.

In addition, the overheating destructive element has a through hole in correspondence with the mounting hole; the contact element has a support stand and two position-limiting pillars, in which the two position-limiting pillars are located on a surface relative to the support stand, wherein one of the position-limiting pillars is extended into the first elastic element to enable the contact element to be pressed against the support stand, and the other position-limiting pillar is extended into the through hole of the overheating destructive element; a width of the support stand is less than that of the mounting hole but greater than that of the through hole.

The present invention further discloses a push switch, comprising:

a base having a receiving space, wherein the base is provided with a protruding portion; an operating component sleeved on the protruding portion, wherein the operating component comprises an operating element and a first elastic element, the operating element reciprocally moves on the protruding portion in a limited manner; a first conductive element penetrated into and provided in the base; a second elastic element which is a U-shaped clip, wherein the U-shaped clip has a fixing portion and a working portion, the fixing portion is integrally formed with the first conductive element; a conductive cantilever element provided in the receiving space and integrally formed with the working portion, wherein the conductive cantilever element has a mounting groove thereon and the mounting groove has a bottom surface; a second conductive element penetrated into and provided in the base, wherein the conductive cantilever element is selectively connected to the second conductive element; an overheating destructive element accommodated in the mounting groove and supported by the bottom surface, wherein the overheating destructive element can be destroyed at a destructive temperature and the destructive temperature is between 100° C. to 250° C.

The first elastic element is compressively limited between the overheating destructive element and the operating element and has a first elastic force, the U-shaped clip has a second elastic force and the second elastic force indirectly acts on the operating element. When the operating element is in a first position, the first elastic force forces the conductive cantilever element to be contacted with the second conductive element so as to form an electrically connected state; in the electrically connected state, currents flow through the first conductive element, the conductive cantilever element and the second conductive element to generate a heat energy, and the overheating destructive element absorbs the heat energy and be destroyed at the above-described destructive temperature, such that the first elastic force is reduced or lost, thus making the second elastic force to be greater than the first elastic force, and the second elastic force forces the operating element to move to a second position, such that the conductive cantilever element becomes separated from the second conductive element to form an electrically disconnected state.

In addition, a thermal conductive shell is accommodated in the mounting groove and supported by the bottom surface; the overheating destructive element is accommodated in the thermal conductive shell so as to receive the heat energy via the thermal conductive shell.

The following effects can be achieved according to the aforesaid technical features:

1. In comparison with the protection techniques by means of a fuse or a double-metal member, the overheating destructive element of the present invention is not used to transmit currents; therefore, when the present invention is applied to an electrical appliance or an extension cord, the transmission of currents is not hampered even though the conductivity of the overheating destructive element is poorer than that of copper or even non-conducting.

2. The conductive member is integrally formed and manufactured, has the advantages of being structurally simple and easy to assemble, and does not obviously increase volume of the switch.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

In summary of the above-described technical features, the main effects of the push switch and the conductive member structure thereof of the present invention can be clearly demonstrated in the following embodiments, wherein the conductive member is a part of the push switch and is used to control the push switch to be electrically connected or electrically disconnected.

Figure 1:
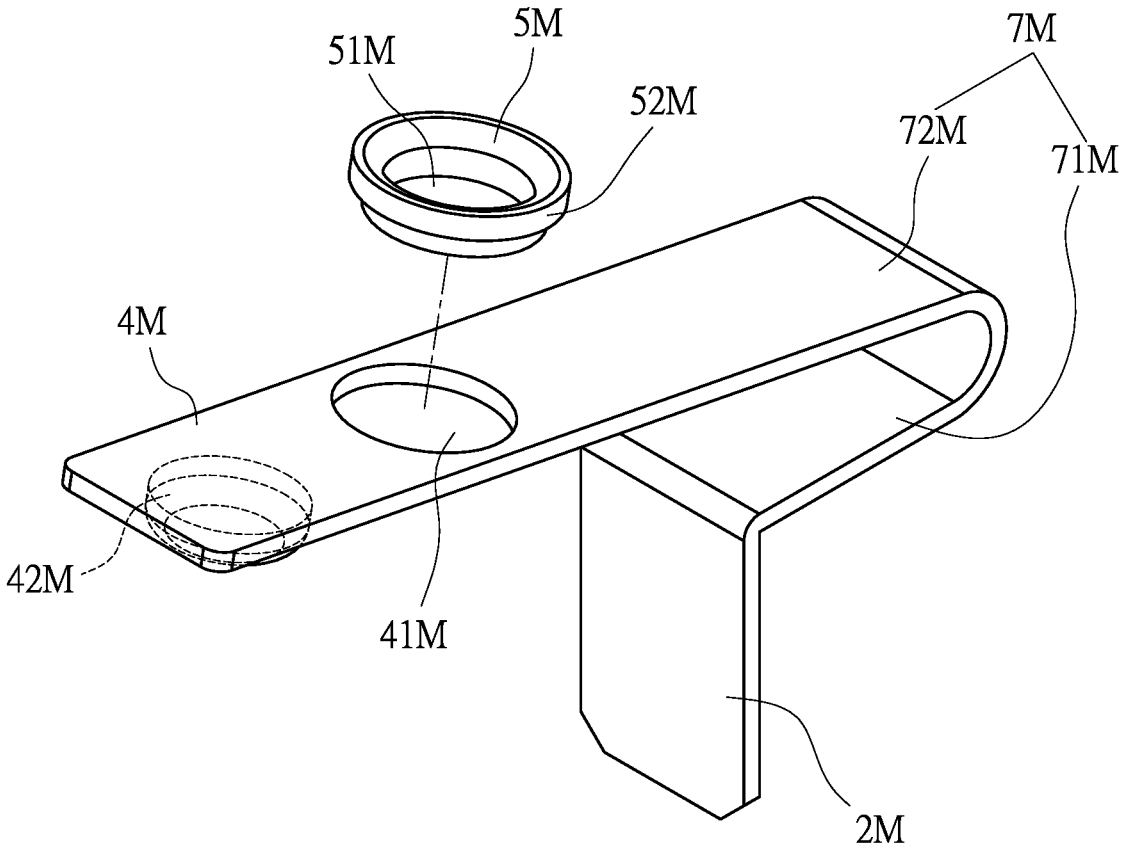
FIG. 1 illustrates a stereoscopic overview of a conductive member structure in accordance with a first embodiment of the present invention.
Figure 2:
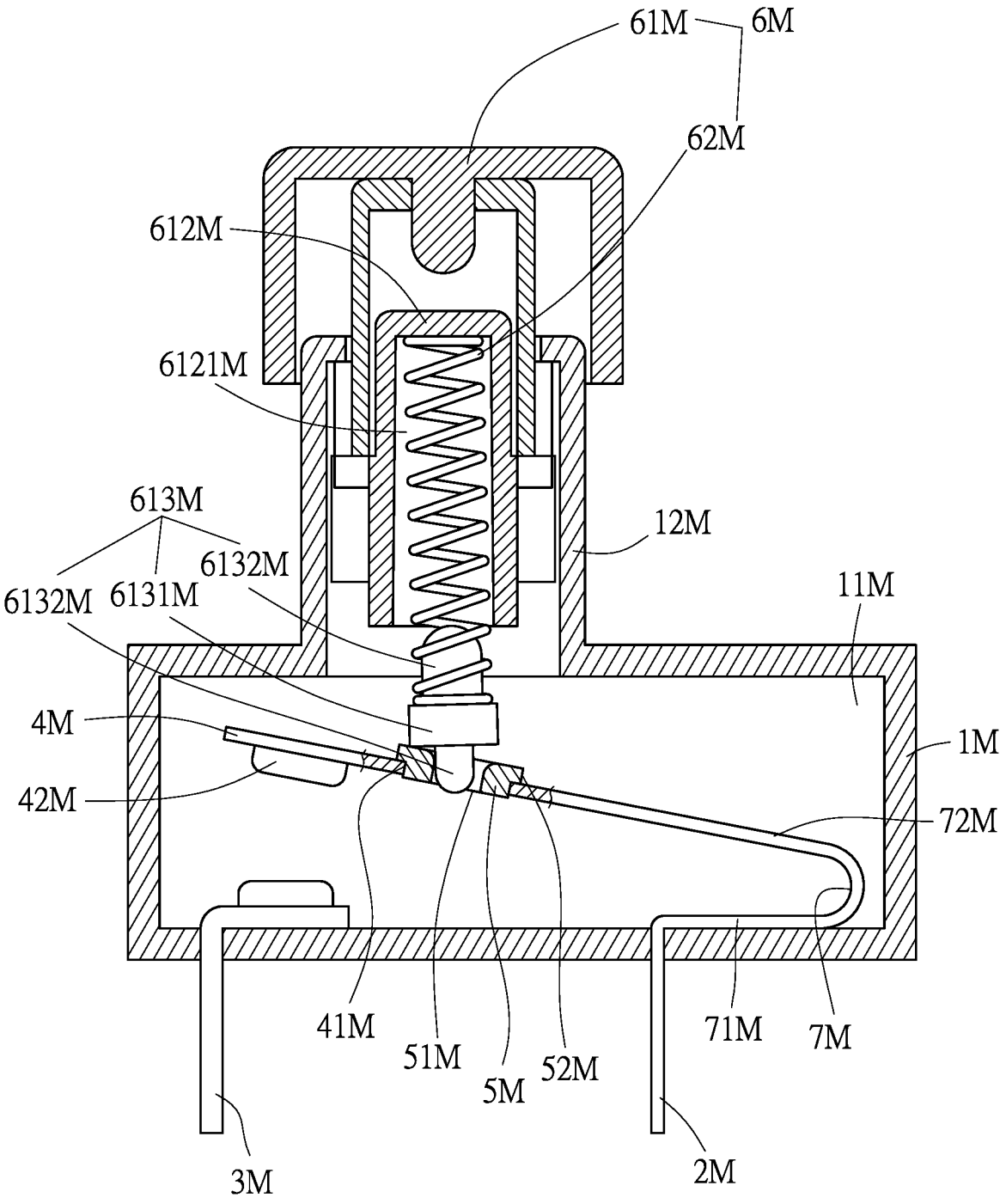
FIG. 2 is a schematic view of a push switch in accordance with the first embodiment of the present invention, which illustrates a structure of the push switch and indicates that the push switch is in a switch-off position.
Figure 3:
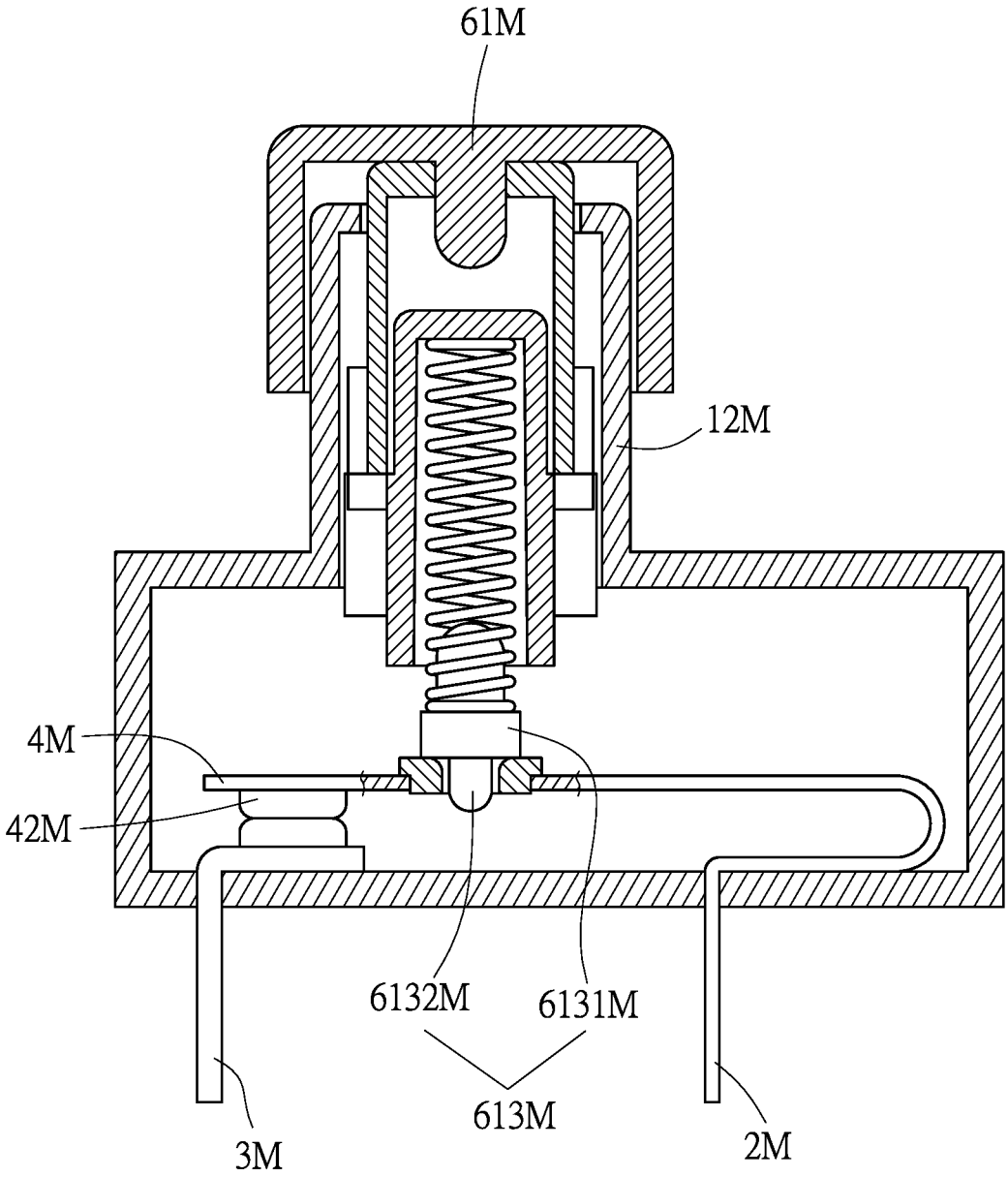
FIG. 3 is a schematic view of the push switch in accordance with the first embodiment of the present invention, which indicates that the push switch is in a switch-on position.

Referring to FIGS. 1, 2 and 3 for a first embodiment of the present invention, a push switch of the embodiment comprises:

a base (1M) having a receiving space (11M) and a protruding portion (12M). A first conductive element (2M) and a second conductive element (3M) both penetrated into and provided in the base (1M), in which the first conductive element (2M) and the second conductive element (3M) are both extended towards the same direction. An operating component (6M) assembled on the base (1M) and comprising an operating element (61M) and a first elastic element (62M), in which the operating element (61M) is sleeved on the protruding portion (12M), and the operating element (61M) is capable of reciprocally moving on the protruding to portion (12M) in a limited manner. The reciprocal movement and the position-fixing structure of the whole operating element (61M) is the same as a push button structure in a conventional automatic ball-point pen, or the structure of the "Button Switch" disclosed in the prior art of China Patent No. CN103441019. Therefore, a few conventional position-fixing structures are omitted in the drawings of the embodiment. A second elastic element, in which the second elastic element is a U-shaped clip (7M), and the U-shaped clip (7M) has a fixing portion (71M) and a working portion (72M), an end of the first conductive element (2M) is bent and extended so as to integrally form the U-shaped clip (7M), and enable the fixing portion (71M) to be connected to the first conductive element (2M) via integral formation. A conductive cantilever element (4M) provided in the receiving space (11M), in which the conductive cantilever element (4M) is integrally formed by extending from the working portion (72M) of the U-shaped clip (7M). Accordingly, the first conductive element (2M), the U-shaped clip (7M) and the conductive cantilever element (4M) integrally form a structure of the conductive member, so as to achieve advantages such as having a simplified structure and ease in assembly. The push switch further has an overheating destructive element (5M) which can be destroyed at a destructive temperature, and the destructive temperature is between 100° C. to 250° C. The overheating destructive element (5M) is not used to maintain a continuous supply of currents, and may be selected from an insulative material such as plastics or selected from a non-insulative material such as an alloy or a metal having a low melting point, wherein the alloy having a low melting point can be an alloy consisted of bismuth and any one or more of cadmium, indium, silver, tin, lead, antimony and copper; for example, a tin-bismuth alloy has a melting point between 138° C. to 148° C. depending on different components therein.

In the embodiment, the operating element (61M) further comprises a limiting element (612M) and a contact element (613M), in which the limiting element (612M) is provided in an inwardly concaved accommodating space (6121M), and the contact element (613M) has a support stand (6131M) and two position-limiting pillars (6132M); the two position-limiting pillars (6132M) are located on a surface relative to the support stand (6131M). The conductive cantilever element (4M) has a mounting hole (41M) thereon; the overheating destructive element (5M) is annular and has a through hole (51M); a width of the support stand (6131M) is less than that of the mounting hole (41M) but greater than that of the through hole (51M), the overheating destructive element (5M) has a rib (52M) extended on the outer periphery thereof; the overheating destructive element (5M) is mounted in the mounting hole (41M), such that through hole (51M) corresponds to the mounting hole (41M) and the rib (52M) is pressed against the periphery of the mounting hole (41M). One of the position-limiting pillars (6132M) of the contact element (613M) is extended into the through hole (51M) of the overheating destructive element (5M), and the first elastic element (62M) is provided in the accommodating space (6121M), wherein the other position-limiting pillar (6132M) of the contact element (613M) is extended into the first elastic element (62M), such that the first elastic element (62M) is pressed against the support stand (6131M), and the first elastic element (62M) is compressed and thus having a first elastic force. The U-shaped clip (7M) has a second elastic force, and the second elastic force indirectly acts on the operating element (61M).

When a working temperature is increased abnormally, a disconnection is preferably generated in the live wire; therefore, the first conductive element (2M) is used as a first end of the live wire, and the second conductive element (3M) is used as a second end of the live wire, such that the first conductive element (2M) and the second conductive element (3M) are connected and conducted via the conductive cantilever element (4M) to form a live wire circuit, or the first conductive element (2M) and the second conductive element (3M) are disconnected and thus disconnecting the live wire.

Referring to FIG. 3, a user operates the operating element (61M) to positionally move relative to the protruding portion (12M), just like operating a button of an automatic ball-point pen, so as to enable the conductive cantilever element (4M) to be selectively contacted with or separated from the second conductive element (3M). When the operating element (61M) positionally moves towards the conductive cantilever element (4M) and becomes fixed, the support stand (6131M) of the contact element (613M) pushes on a silver contact point (42M) of the conductive cantilever element (4M), such that the conductive cantilever element (4M) is contacted with the second conductive element (3M) to form an electrically connected state.

Figure 4:
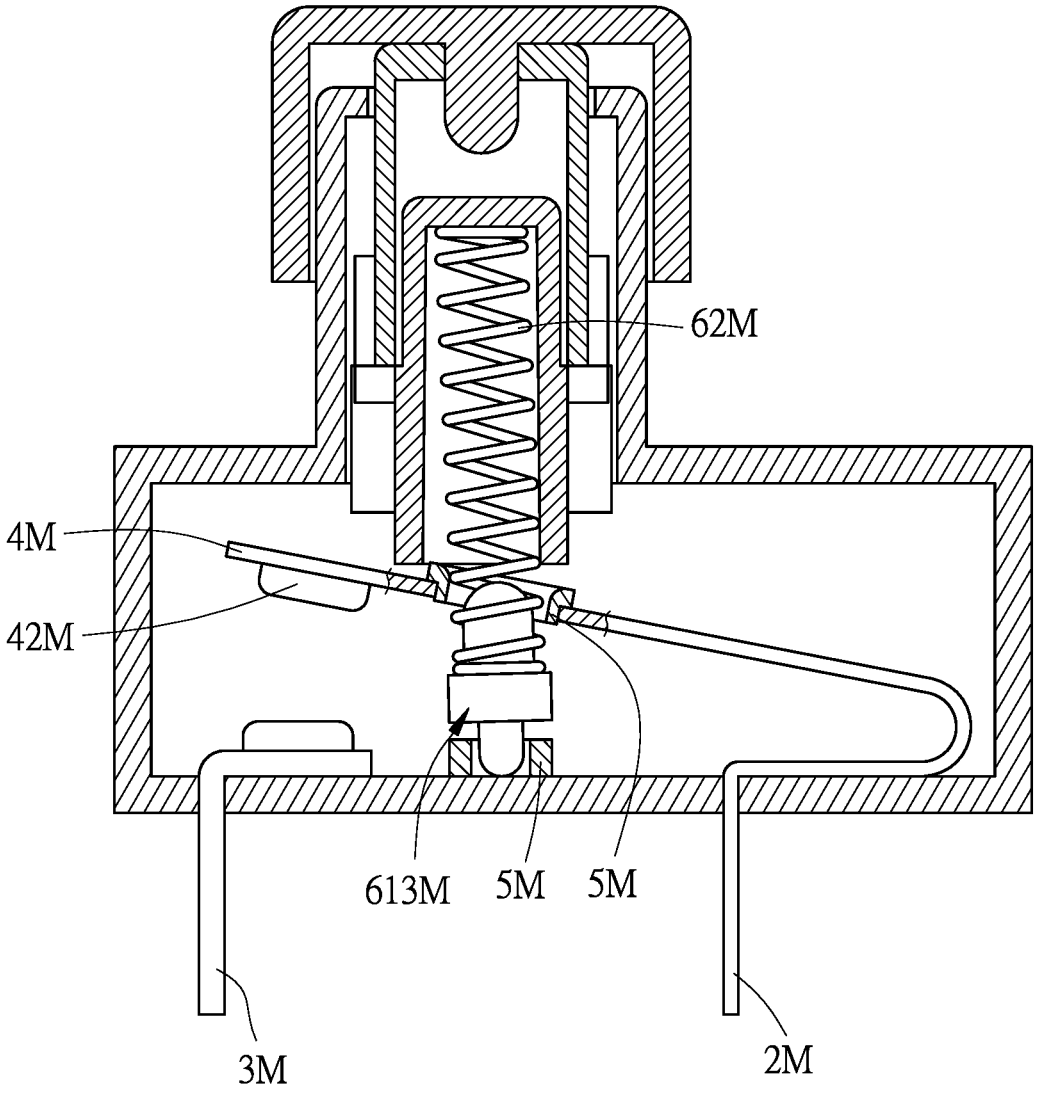
FIG. 4 is a schematic view of the push switch in accordance with the first embodiment of the present invention, which indicates that when the overheating destructive element is overheated and destroyed, the conductive cantilever element is separated from the second conductive element so as to enable the push switch to be returned to the switch-off position from the switch-on position, thereby achieving protection from overheating.

Referring to FIG. 4, when an external conducting apparatus connected to the first conductive element (2M) or the second conductive element (3M) is in an abnormal state; for example, the external conducting apparatus may be a power socket, and when there are oxidizing substances, dusts, incomplete insertion of metal pins and deformations of metal pins present between the metal pins of a plug and the power socket, consequently resulting in the generation of a greater heat energy in a conductive part of the power socket, the heat energy is transmitted to the conductive cantilever element (4M) via the first conductive element (2M) or the second conductive element (3M), and then further transmitted to the overheating destructive element (5M) via the conductive cantilever element (4M); the overheating destructive element (5M) absorbs the heat energy and gradually reaches a material melting point thereof, and the rigidity of the overheating destructive element (5M) is gradually lost at this point; for example, the overheating destructive element (5M) may be made of a tin-bismuth alloy, and although a melting point thereof is 148° C., the rigidity is gradually lost when a temperature thereof is close to the melting point. Under the effect of the first elastic force, the contact element (613M) is compressed by the first elastic element (62M), and then the contact element (613M) further compresses the overheating destructive element (5M), such that the overheating destructive element (5M) is compressed and deformed or even destroyed, and thus cannot limit the first elastic element (62M) any longer; the first elastic force becomes less or lost and makes the second elastic force greater than the first elastic force, thus forcing the conductive cantilever element (4M) to be restored, and the silver contact point (42M) of the conductive cantilever element (4M) is separated from the second conductive element (3M), thereby forming an electrically disconnected state and achieving protection against overheating.

Figure 5:
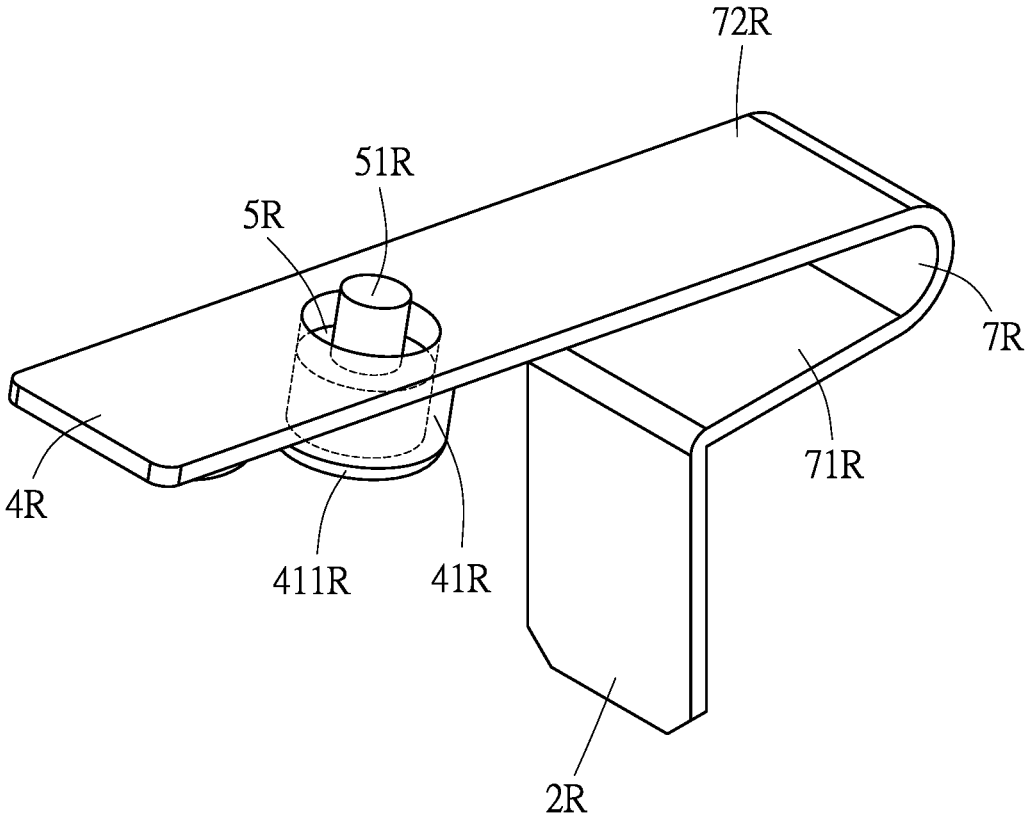
FIG. 5 illustrates a stereoscopic overview of a conductive member structure in accordance with a second embodiment of the present invention.
Figure 6:
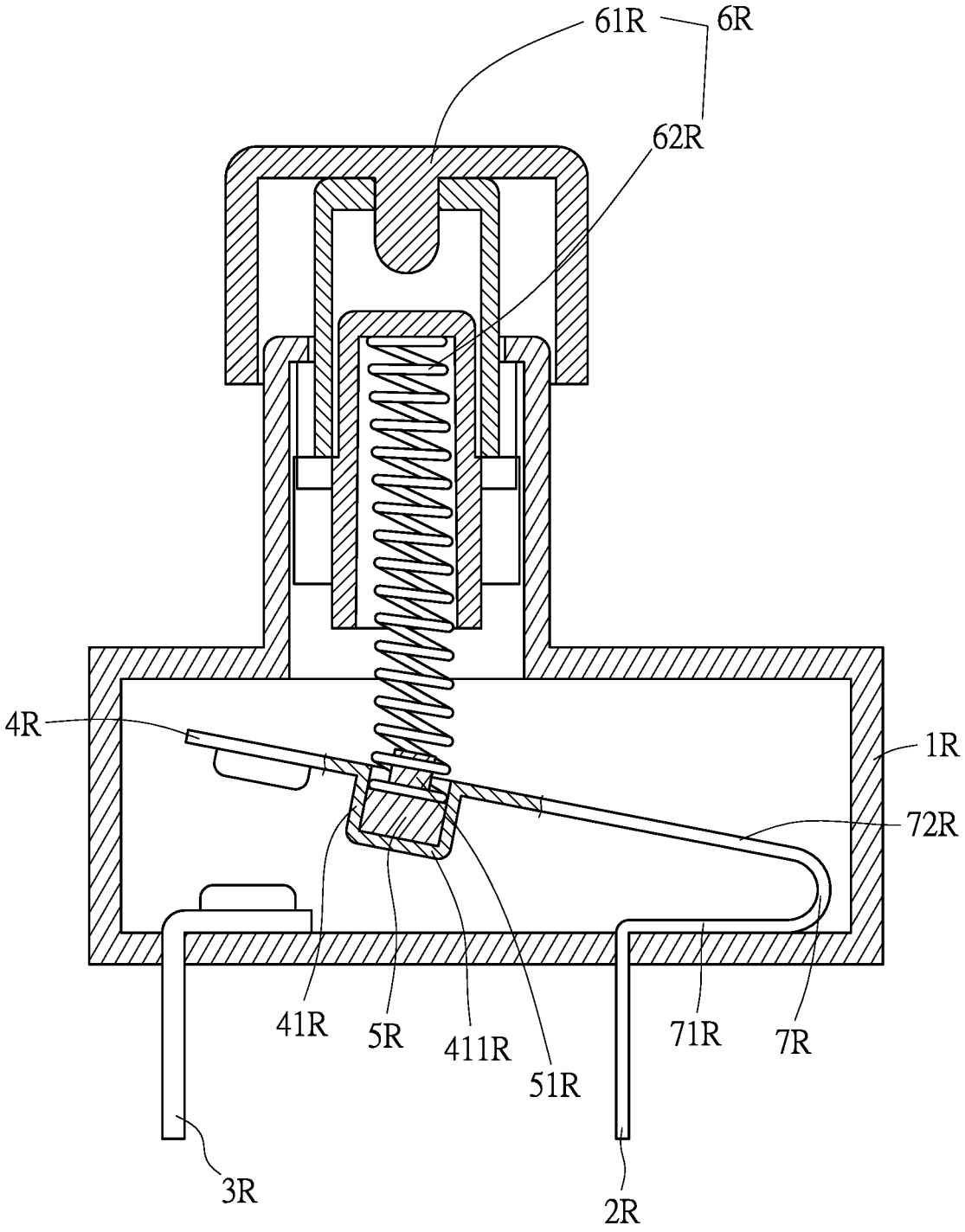
FIG. 6 is a schematic view of a push switch in accordance with the second embodiment of the present invention, which illustrates a structure of the push switch and indicates that the push switch is in a switch-off position.

Referring to FIGS. 5 and 6 for a second embodiment of the present invention, a push switch of the embodiment differs from that of the first embodiment in that the embodiment comprises:

a base (1R); a first conductive element (2R) and a second conductive element (3R) penetrated into and provided in the base (1R). An operating component (6R) assembled on the base (1R) and comprising an operating element (61R) and a first elastic element (62R). A second elastic element, in which the second elastic element is a U-shaped clip (7R), and the U-shaped clip (7R) has a fixing portion (71R) and a working portion (72R), an end of the first conductive element (2R) is bent and extended so as to integrally form the U-shaped clip (7R), thus enable the fixing portion (71R) to be connected to the first conductive element (2R) via integral formation. A conductive cantilever element (4R) is integrally formed by extending from the working portion (72R) of the U-shaped clip (7R). Accordingly, the first conductive element (2R), the U-shaped clip (7R) and the conductive cantilever element (4R) integrally form a structure of the conductive member, so as to achieve advantages such as having a simplified structure and ease in assembly. The push switch further has an overheating destructive element (5R), in which the overheating destructive element (5R) has a jutting portion (51R). The conductive cantilever element (4R) has a mounting groove (41R) thereon and the mounting groove (41R) has a bottom surface (411R); the overheating destructive element (5R) is directly accommodated in the mounting groove (41R) and supported by the bottom surface (411R). The first elastic element (62R) has one end thereof pressed against the operating element (61R) and another end thereof sleeved on the jutting portion (51R) of the overheating destructive element (5R), and the first elastic element (62R) is thus compressively limited between the overheating destructive element (5R) and the operating element (61R) and has a first elastic force. The U-shaped clip (7R) has a second elastic force, and the second elastic force acts on the operating element (61R).

Figure 7:
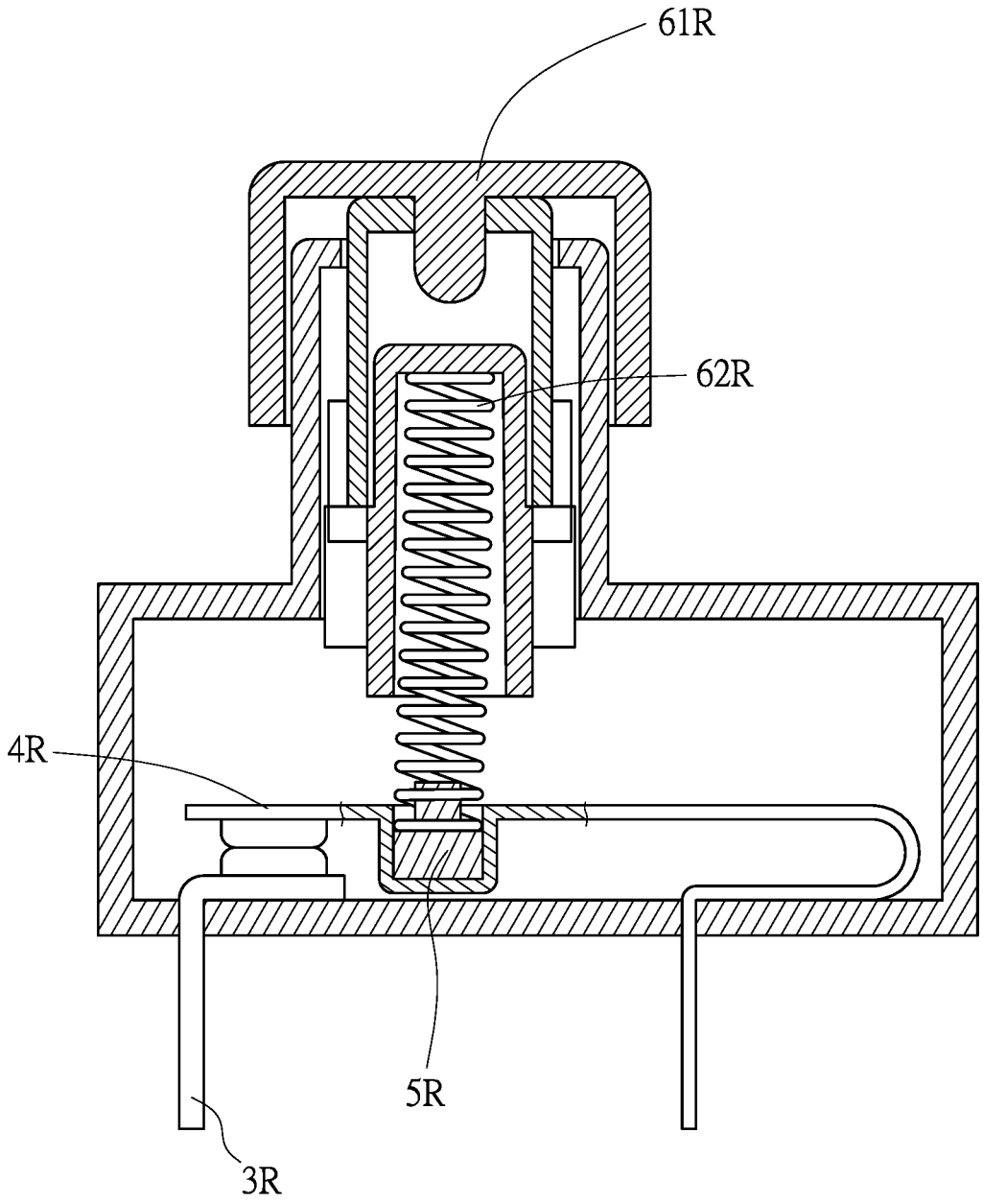
FIG. 7 is a schematic view of the push switch in accordance with the second embodiment of the present invention, which indicates that the push switch is in a switch-on position.
Figure 8:
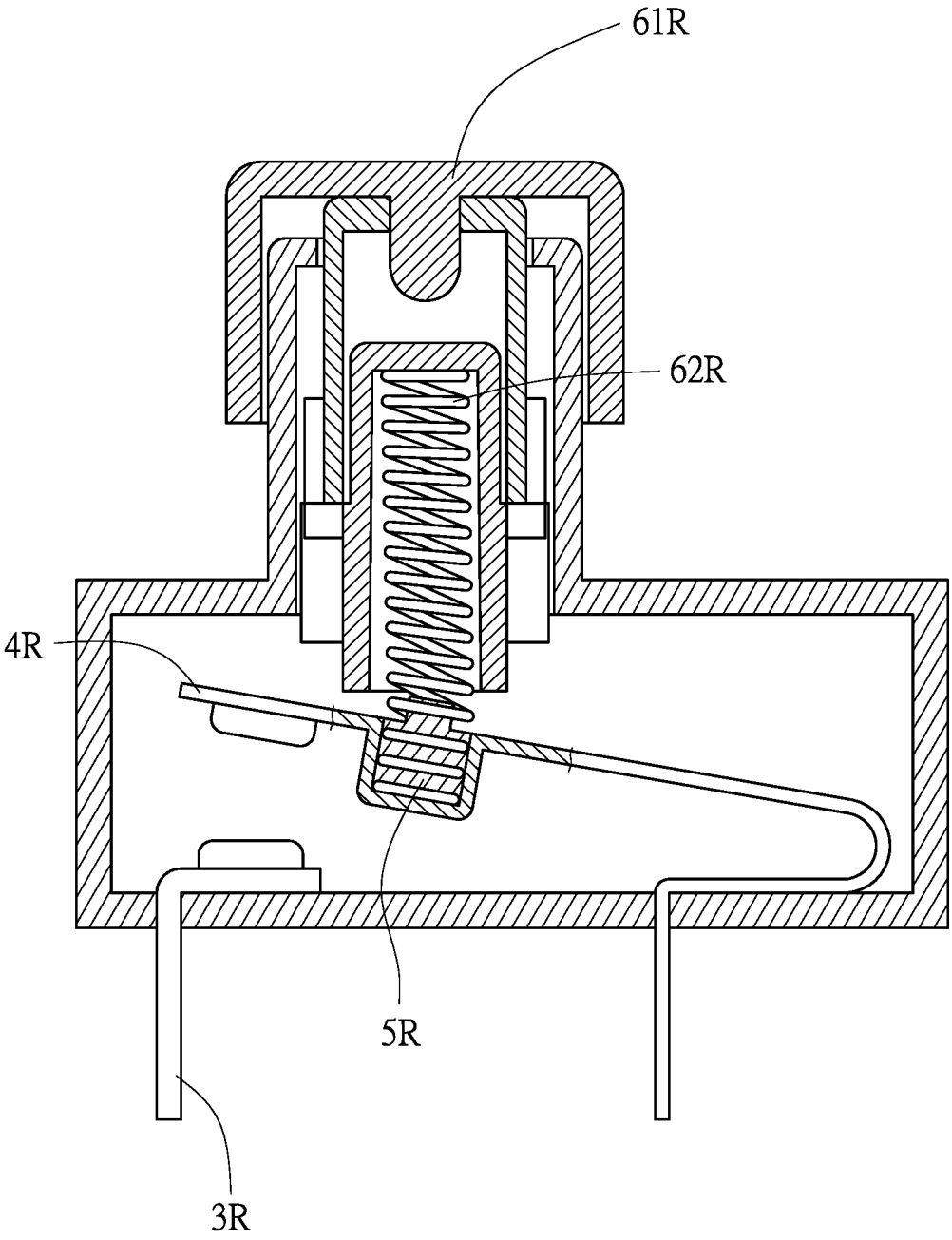
FIG. 8 is a schematic view of the push switch in accordance with the second embodiment of the present invention, which indicates that when the overheating destructive element is overheated and destroyed, the conductive cantilever element is separated from the second conductive element so as to enable the push switch to be returned to the switch-off position from the switch-on position, thereby achieving protection from overheating.

Referring to FIGS. 7 and 8, when the conductive cantilever element (4R) is enabled to be contacted with the second conductive element (3R) to form an electrically connected state by operating the operating element (61R), and when the overheating destructive element (5R) becomes softened due to overheating and consequently lacking to sufficient rigidity for compressing the first elastic element (62R), the overheating destructive element (5R) is pressed and deformed or even destroyed and can no longer limit the first elastic element (62R), and the first elastic force is lessened or lost as a result; the second elastic force becomes greater than the first elastic force at the moment, thus forcing the conductive cantilever element (4R) to be restored and separated from the second conductive element (3R), thereby forming an electrically disconnected state and achieving protection against overheating.

Figure 9:
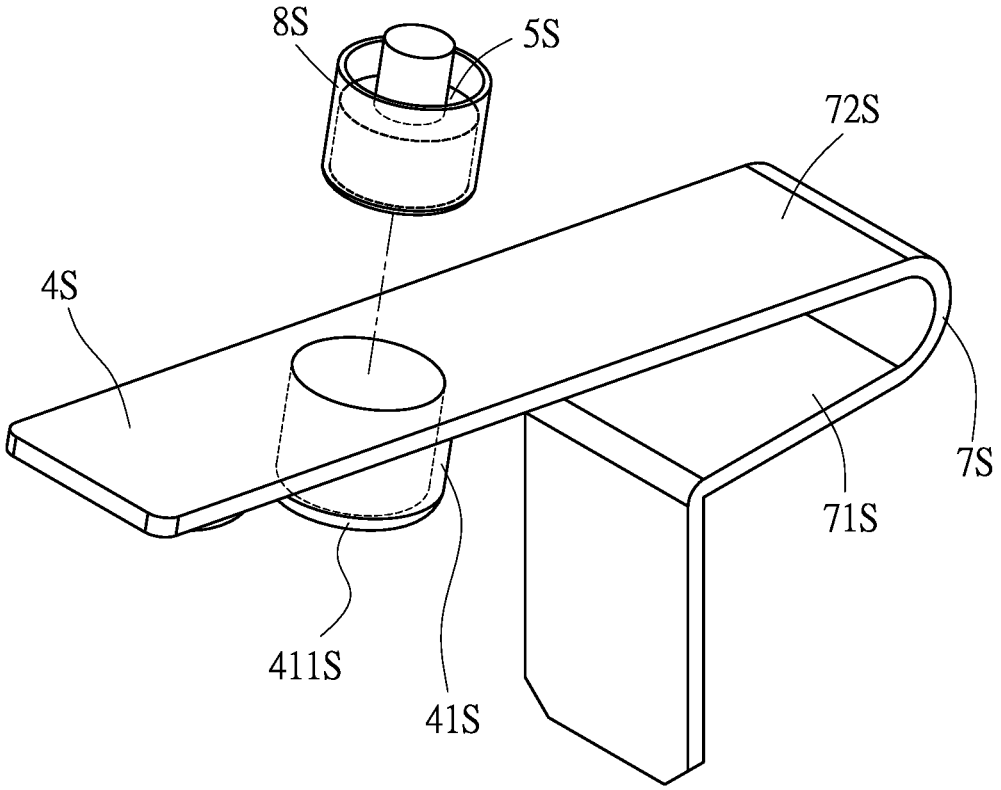
FIG. 9 illustrates a stereoscopic overview of a conductive member structure in accordance with a third embodiment of the present invention.
Figure 10:
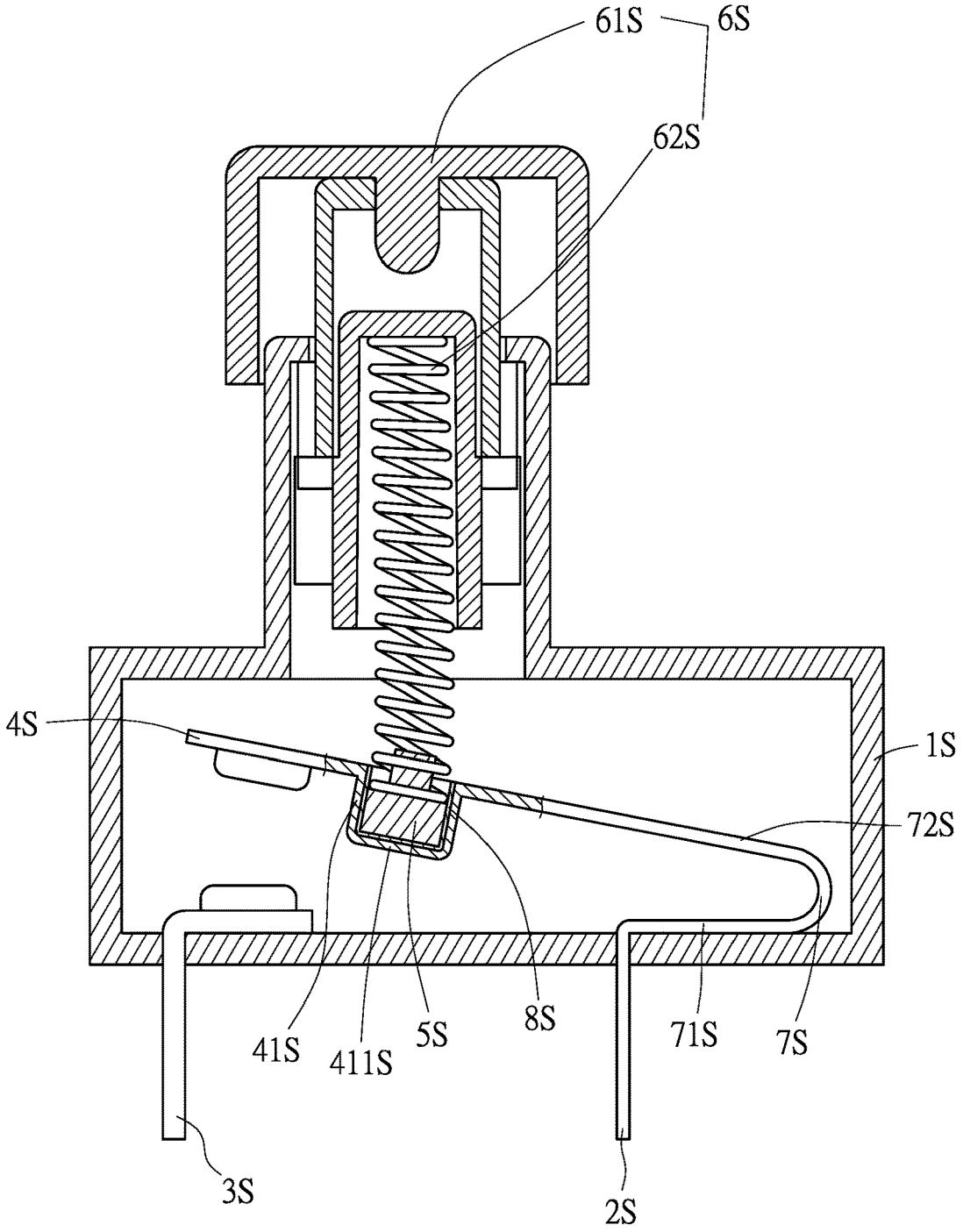
FIG. 10 is a schematic view of a push switch in accordance with the third embodiment of the present invention.

Referring to FIGS. 9 and 10 for a third embodiment of the present invention, the embodiment is a variation of the second embodiment, and differs from the second embodiment in that the embodiment comprises:

a base (1S); a first conductive element (2S) and a second conductive element (3S) penetrated into and provided in the base (1S). An operating component (6S) assembled on the base (1S) and comprising an operating element (61S) and a first elastic element (62S). A second elastic element, in which the second elastic element is a U-shaped clip (7S), and the U-shaped clip (7S) has a fixing portion (71S) and a working portion (72S), an end of the first conductive element (2S) is bent and extended so as to integrally form the U-shaped clip (7S), thus enable the fixing portion (71S) to be connected to the first conductive element (2S) via integral formation. A conductive cantilever element (4S) is integrally formed by extending from the working portion (72S) of the U-shaped clip (7S). Accordingly, the first conductive element (2S), the U-shaped clip (7S) and the conductive cantilever element (4S) integrally form a structure of the conductive member, so as to achieve advantages such as having a simplified structure and ease in assembly. The push switch further comprises an overheating destructive element (5S). The conductive cantilever element (4S) has a mounting groove (41S) thereon and the mounting groove (41S) has a bottom surface (411S), a thermal conductive shell (8S) is accommodated in the mounting groove (41S) and supported by the bottom surface (411S), and the overheating destructive element (5S) is accommodated in the thermal conductive shell (8S). The first elastic element (62S) is compressively limited between the overheating destructive element (5S) and the operating element (61S) and has a first elastic force. The U-shaped clip (7S) has a second elastic force, and the second elastic force indirectly acts on the operating element (61S).

In use, the embodiment works in the same way as the second embodiment; however, the sensitivity of the push switch of the embodiment is increased by having the thermal conductive shell (8S) made from a material having better thermal conductivity, so as to achieve better thermal conduction to the overheating destructive element (5S).

In summary of the description of the aforesaid embodiments, it is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A push switch, comprising:

a base having a receiving space, wherein the base is provided with a protruding portion;

an operating component sleeved on the protruding portion, wherein the operating component comprises an operating element and a first elastic element, the operating element reciprocally moves on the protruding portion in a limited manner and comprises a contact element and a limiting element, the first elastic element is compressively limited between the contact element and the limiting element and has a first elastic force;

a first conductive element penetrated into and provided in the base;

a second elastic element which is a U-shaped clip, wherein the U-shaped clip has a fixing portion and a working portion, the fixing portion is integrally formed with the first conductive element, and the U-shaped clip has a second elastic force which indirectly acts on the operating element;

a conductive cantilever element provided in the receiving space and integrally formed with the working portion, wherein the conductive cantilever element has a mounting hole thereon;

a second conductive element penetrated into and provided in the base, wherein the conductive cantilever element is selectively connected to the second conductive element;

an overheating destructive element accommodated in the mounting hole and pressed against the contact element, wherein the overheating destructive element can be destroyed at a destructive temperature and the destructive temperature is between 100° C. to 250° C.;

when the operating element is in a first position, the first elastic force forces the conductive cantilever element to be contacted with the second conductive element to form an electrically connected state, in the electrically connected state, currents flow through the first conductive element, the conductive cantilever element and the second conductive element to generate a heat energy, the overheating destructive element absorbs the heat energy and be destroyed at the destructive temperature, such that the first elastic force is reduced or lost, thus making the second elastic force to be greater than the first elastic force, and the second elastic force forces the operating element to move to a second position, hence the conductive cantilever element is separated from the second conductive element and thus forming an electrically disconnected state.

2. The push switch of claim 1, wherein the overheating destructive element has a through hole in correspondence with the mounting hole, and the overheating destructive element has a rib on its periphery thereof, the overheating destructive element is penetrated and extended into the mounting hole and is tightly cooperated with an inner edge of the mounting hole, such that the rib is pressed against a periphery of the mounting hole.

3. The push switch of claim 1, wherein the conductive cantilever element has a silver contact point thereon.

* * * * *